United States Patent [19]

Van Dell

[11] 4,097,958

[45] Jul. 4, 1978

[54] RUBBER TORSION SPRING HOOD HINGE FOR AUTOMOTIVE VEHICLE

[75] Inventor: Clarence Arthur Van Dell, Franklin Village, Mich.

[73] Assignee: Dura Corporation, Southfield, Mich.

[21] Appl. No.: 789,109

[22] Filed: Apr. 20, 1977

[51] Int. Cl.[2] ..... E05D 1/04; E05D 11/10

[52] U.S. Cl. ..... 16/128.1; 16/145; 16/180; 180/69 C

[58] Field of Search ..... 16/128.1, 128 R, 142, 16/145, 180; 180/69 C

[56] References Cited

U.S. PATENT DOCUMENTS

| | | | |
|---|---|---|---|
| 1,721,288 | 7/1929 | Thiry | 16/180 |
| 3,069,720 | 12/1962 | Gessler | 16/128.1 |
| 3.153,260 | 10/1964 | Gionet | 16/142 |
| 3,469,277 | 9/1969 | Henrichs et al. | 16/145 |

FOREIGN PATENT DOCUMENTS

| | | | |
|---|---|---|---|
| 150,837 | 7/1955 | Sweden | 16/128 R |
| 466,922 | 6/1937 | United Kingdom | 16/128 R |
| 799,601 | 8/1958 | United Kingdom | 16/180 |
| 1,273,876 | 5/1972 | United Kingdom | 16/128.1 |

*Primary Examiner*—James Kee Chi

*Attorney, Agent, or Firm*—Hill, Gross, Simpson, Van Santen, Steadman, Chiara & Simpson

[57] ABSTRACT

A hinge for connecting automobile hoods to the remainder of the vehicle which includes a bracket member attached to the vehicle supporting a non-rotating cylindrical elongated member with a thick elastomeric torsion spring received around the cylindrical member and bonded thereto at an inner diameter of the torsion spring. A hinge strap is received around the outer diameter of the rubber torsion spring and fastened thereto in non-relative rotating fashion. The hinge strap may be provided with an extension to which a vehicle hood may be attached and the assembly can be installed with the hinge strap projecting upwardly into a hood open position. Closure of the hood will then tension the spring.

8 Claims, 4 Drawing Figures

RUBBER TORSION SPRING HOOD HINGE FOR AUTOMOTIVE VEHICLE

BACKGROUND OF THE INVENTION

1. Field of the Invention

This invention relates to automotive hood hinges and more particularly to an elastomeric torsion hood hinge.

2. Prior Art

Automotive vehicle hoods and trunk lids, herein both referred to as hoods, are normally attached to the remainder of the body through a hinge connection allowing a pivoting opening of the hood. Although many different hinges have been suggested, the most common fall into two categories, i.e., free hinges and spring hinges. Free hinges offer no resistance to the closing of the hood and do not counterbalance the weight of the hood when opened. Such free hinges require the use of manual support braces when the hood is to be left open.

Spring hinges, on the other hand, normally employ spring devices to maintain the hood in an open position and to resist closure. The spring devices are, most popularly steel torsion springs. Such spring hinges offer a distinct advantage over free hinges in that they automatically maintain the hood in an elevated position when it is not positively latched in a closed position.

Recent vehicle design has greatly emphasized weight reduction. Such steel torsion springs, and their attended support structure represent an added weight which neither contributes to the operation of the vehicle nor to its appearance.

Although it is known that rubber springs can offer a weight reduction over steel springs in many instances, they have not heretofore found acceptance as vehicle hood hold-open devices.

It would therefore be an advance in the art to provide a lightweight hood hold-open hinge device and more particularly one employing the use of rubber torsion springs.

SUMMARY OF THE INVENTION

My invention overcomes the disadvantages inherent in the prior art and provides an elastomeric torsion spring hood hinge assembly. The assembly includes a bracket member to be attached to the vehicle at the pivot point of the hood hinge assembly. The bracket includes an elongated cylindrical member which has a length in radial clearance with respect to remaining portions of the bracket. The cylindrical member is restrained against rotation with respect to the bracket.

A rubber torsion spring is received around the cylindrical member and, in one embodiment illustrated comprises a thick walled rubber tube. The inner diameter of the tube is bonded or otherwise secured to the outer diameter of the cylindrical member. A hinge strap is bonded or otherwise secured to the outer diameter of the rubber torsion spring. In this manner relative rotation between the hinge strap and the cylindrical member will be accommodated by torsion flow within the rubber of the torsion spring. Due to the resilient memory of the elastomer of the rubber spring, rotation of the hinge strap with respect to the cylindrical member will be resisted with force sufficient to return the hinge strap to a rest position.

The hinge strap has a projecting arm portion which serves as an attachment base for the vehicle hood.

The assembly is installed in the vehicle with the projecting arm extending upwardly in a hood open direction at an angle which is predetermined to offer a resistance to rotation of the arm sufficient to maintain a hood of given weight at an open position. Thereafter closure of the hood will rotate the arm increasing the force generated by the torsion spring tending to counterrotate the arm. When the hood is in the fully closed position, the normally used latch will maintain it closed. When the latch is released, the stored energy within the torsion spring will aid in opening in the hood by urging the projecting arm to the hood open position.

In order to insure that the hood will be retained in the open position, I have provided a protrusion on the outer surface of the hinge strap radially outwardly from the torsion spring. This protrusion cooperates with a cam protrusion on the bracket. The protrusion on the strap and the protrusion on the bracket are spaced with respect to one another such that they will come in contact during opening of the hood preventing further opening movement unless one of them moves with respect to the other in other than an opening direction. This movement is accommodated by compression of the torsion spring radially inwardly of the protrustion to allow the strap protrusion to pass the cam. Once past the cam, reverse direction movement of the hood will again require compression of the spring. Thus closure of the hood must be intentional in that a larger force must be applied initially to begin closure than is required to continue a closure movement.

It is therefore and object of this invention to provide a rubber torsion spring hood hinge for automotive vehicles.

It is another object of this invention to provide an elastomeric torsion hood hinge for automotive vehicles having a vehicle carried bracket supporting a non-rotatable core member with an elastomer torsion spring received around the core member and bonded thereto with a hood attachable hinge strap received around the torsion spring in non-rotatable relationship therewith whereby rotation of the hinge strap will be accommodated by torsional flow within the elastomer of the torsion spring.

It is another, more particular, object of this invention to provide an elastomeric torsion spring vehicle hood hinge assembly having an abutting stationary cam and a torsion spring carried rotatable projection engageable with the cam at a point of rotation of the spring prior to a full hood open position, further rotation to the full hood open position requiring compression of the torsion spring to pass the projection beyond the cam, abutment of the projection and cam thereafter aiding and maintaining the hood in a full-open position.

Other objects, features and advantages of the invention will be readily apparent from the following description of a preferred embodiment thereof, taken in conjunction with the accompanying drawings, although variations and modifications may be effected without departing from the spirit and scope of the novel concepts of the disclosure, and in which:

DESCRIPTION OF THE PREFERRED EMBODIMENTS

Figure 1:
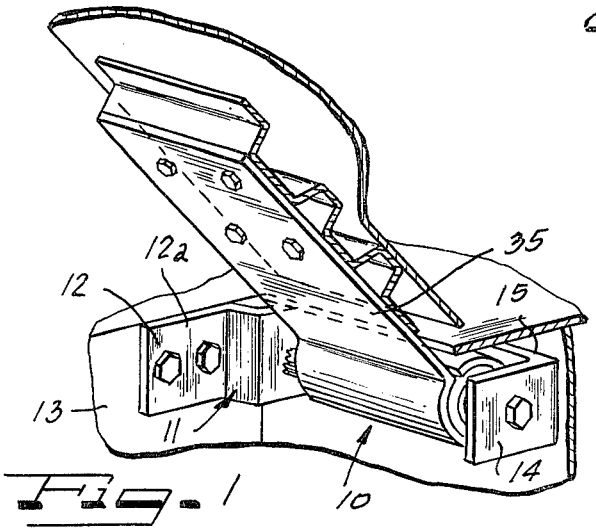
FIG. 1 is a fragmentary perspective view of a hood hinge according to this invention installed in a vehicle.

FIG. 1 illustrates the hinge assembly 10 of this invention in place in an automotive vehicle. The assembly includes a bracket 11 which is somewhat U-shape having a longer leg 12 outwardly offset adjacent its end providing a fender wall attachment section 12*a*. Section 12*a* may be attached to the vehicle inner fender wall 13 or other vehicle structure by means such as the illustrated bolts. The bracket 11 also includes a short leg 14 and a bight section 15. The bight section may be attached to the cowl or fire wall 19 as by means such as bolts 22. The offset 16 on the long leg 12 provides a space 17 between the fender wall 18 and the cowl or fire wall 19. Aligned bores 20 through the short leg 14 and the long leg 12 receive a pivot member such as a bolt 24. The space 17 provides an area in which a nut 25 can be affixed to the bolt so that the bolt may be selectively tightened.

Figure 2:
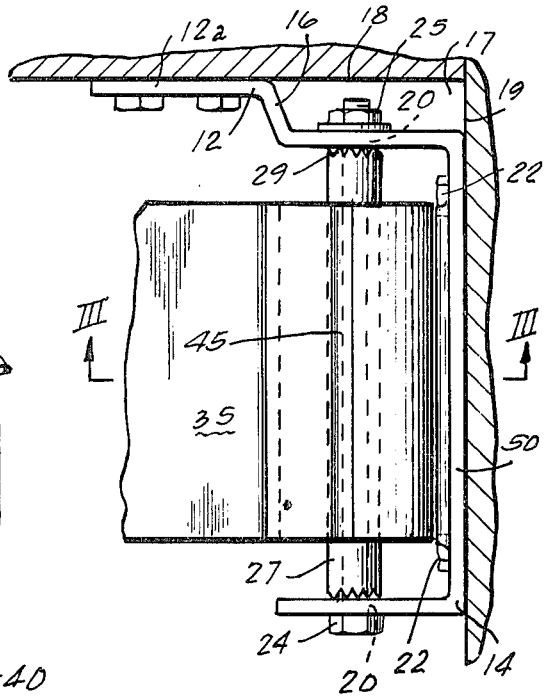
FIG. 2 is a fragmentary top view of the hinge of FIG. 1 showing portions of the vehicle in section.

An elongated cylindrical member 27 is received around the bolt intermediate the legs 12 and 14 and is restrained against rotation with respect to the bracket. As illustrated in FIG. 2, the restraint against rotation may take the form of serrated end faces 29 contacting the inside faces of the legs 12 and 14. The serrated end faces 29 may be brought into biting engagement with the material of the bracket under the tightening influence of the bolt 24 received through the cylindrical member.

Figure 3:
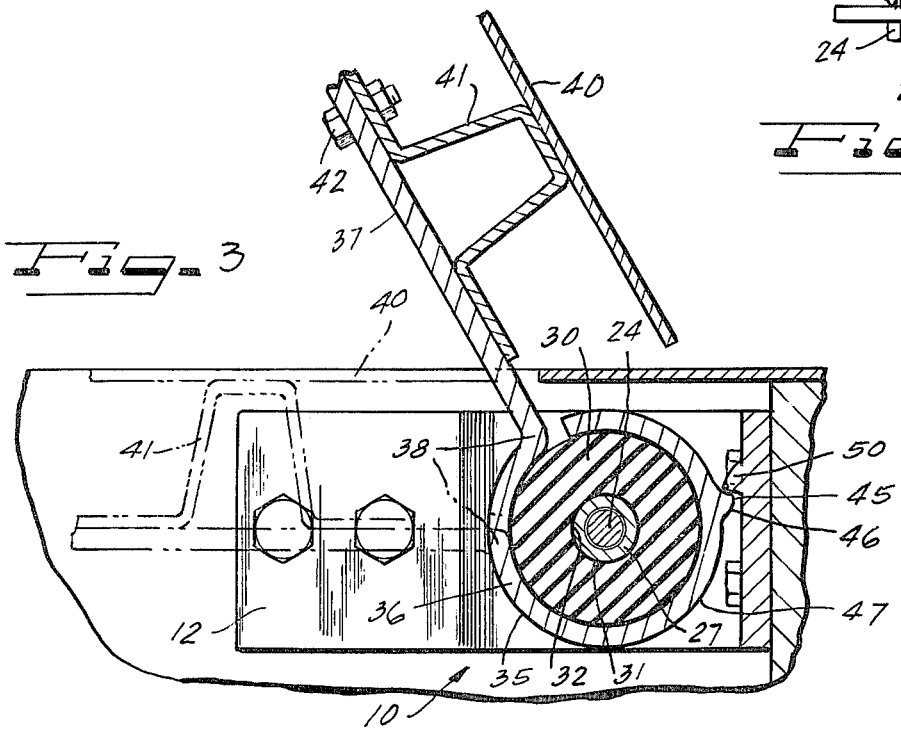
FIG. 3 is a fragmentary cross-sectional view of the hinge of FIGS. 1 and 2 taken along the line III—III of FIG. 2.

As best illustrated in FIG. 3, a thick walled tube of elastomer 30 is received around the cylindrical member. The tube 30 has an inner diameter 31 which is affixed to the outer diameter 32 of the cylindrical member by any appropriate fastening means such as vulcanizing, bonding, cementing or the like. In this manner relative rotation between the cylindrical member 27 and the elastomer tube 30 is prevented.

A hinge strap 35 has an end portion 36 which is bent to form a circle received around the elastomer tube 30 and fastened thereto by fastening means preventing relative rotation between the end portion 36 and the outer diameter of the tube 30. An attachment arm 37 of the hinge strap 35 projects from the end 36 through an angle bend 38 and forms a base for attachment of the hood 40. Spacer elements 41 may be attached to the arm 37 by means such as bolts 42 with the sheet metal of the hood 40 attached to the spacer elements by means such as spot welding or the like. Of course, as will be appreciated by those skilled in the art, the spacer members may be the strengthening frame for the hood or may themselves be attached to the strenthening frame for the hood.

Figure 4:
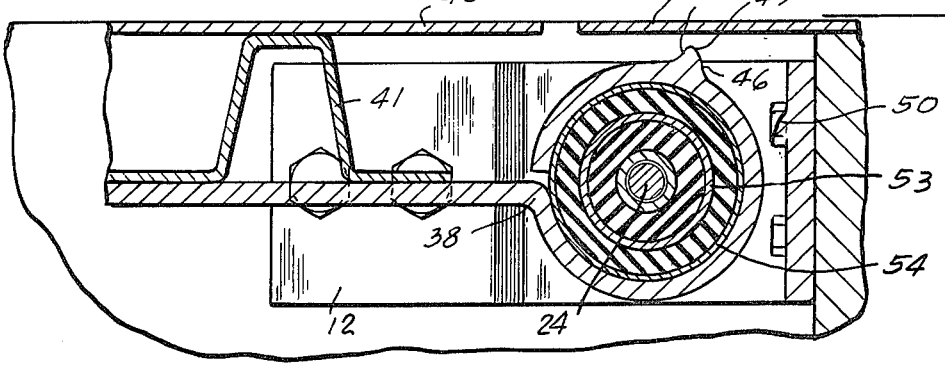
FIG. 4 is a view similar to FIG. 3 illustrating a modification of the torsion spring of this invention.

As best illustrated in FIG. 4, the height of the spacer members 41 and the position of the bend 38 are chosen such that the torsion spring formed by the cylindrical member 27 attached to the bracket, the elastomeric tube 30 and the portion 36, the hinge strap can be received under the cowl projection 43 of the vehicle with the hood 40 flush with the cowl projection when the hinge strap has been rotated to the hood closed position illustrated in FIG. 4.

As will be apparent from the above and from the drawings, the bolt 24 thus forms a pivot point for the hinge and the hood is pivotable about the hinge from a hood open to a hood close position. Of course, in practice, two hinge assemblies will be provided, one on each side of the hood. Where particularly longer heavier hoods are used, one or two additional hinges may be placed intermediate the sides.

When assembled, the hinge assembly illustrated will have a rest position with the arm 37 projecting at a given angle from the horizontal. In order to accommodate the weight of the hood, the assembly may be installed in the vehicle with a free rest position which is rotated, in the example illustrated in FIG. 3, clockwise further than the full hood open position illustrated. Thus when the weight of the hood is attached to the arm 37, that weight will cause a counterclockwise rotation of the hinge strap with respect to the cylindrical member which is held stationary. This counterclockwise rotation is accommodated by torsional displacement within the elastomeric tube 30 which torsional displacement is resisted by the elastomeric memory of the elastomer. In this manner, a hood open rest position can be obtained where the rubber torsion spring formed by the combination of the cylindrical member 27, the rubber tube 30 and the hinge strap portion 36 will be under torsional tension as sufficient to hold the hood open.

Thereafter, as the hood is closed from the position illustrated in FIG. 3 to the position illustrated in FIG. 4, a further torsional displacement will occur within the elastomer of the tube resulting in a greater resistance. With the hood in the closed position. It will be held by the hood latch as is well known to those practiced in the art. When the hood latch is released, the stored torsional energy within the elastomer will assist in returning the hood to the open position illustrated in FIG. 3.

In order to assure that the hood will be maintained in the hood open position, the curved portion 36 of the hinge strap 35 may have an outer diameter projection or projections 45 formed thereon having relatively sloping cam faces 46 extending outwardly from the normal outer diameter 47 of the portion 36 to an apex 49. A cam projection 50 attached to the bight 15 of the bracket member extends inwardly towards the portion 36 of the hinge strap a sufficient distance such that it forms an abutment for the cam faces 46 of the projection 45. The cam 50 and the projection 46 are spaced with respect to one another such that during opening of the hood to a full open position illustrated in FIG. 3, the projection 46 must pass the cam 50 to the position illustrated. In order for the projection 46 to pass the cam 50, it must move radially inwardly towards the pivot bolt 24. Because the tube 30 is formed of somewhat compressible elastomer, the projection can move by compression of a portion of the tube 30. Of course, this compression will be resisted within the elastomer, thereby necessitating an additional force to be applied to the hood to move the projection 46 past the cam 50. Once past the cam 50, the forces compressing the elastomer will be released and the projection will underlie the cam 50 thereby aiding in maintaining the hood in an open position. In order to move the hood to a closed position, the projection 46 must once again pass the cam 50, thereby requiring a recompression of the rubber. This can only be obtained by providing an added closure force.

Thus, the interfering projection 46 and the cam 50 function as an overcenter stop member which aids in retaining the assembly in a full open position.

In those instances where it is desired to provide resistance to radial compression while maintaining the ability to undergo full torsional displacement, one or more intermediate non-compressible layers 53 may be provided within the elastomer. As illustrated in FIG. 4, these layers may be metal tubes or thin metal sheets bonded within the elastomer. Further, they may be concentric tubes, or in some embodiments, may be a spirally wound metal sheet bonded within the elastomer. Such intermediate relatively incompressible layers reduce radial compressibility of the unit without significantly adversely effecting the torsional displacement ability.

Further, in order to provide a secure mount of the hinge strap, the elastomer may be formed initially with an outer diameter metal sheath 54 to which the hinge strap can be applied and affixed by means such as braising, welding, cementing, clamping or the like.

It will therefore be seen from the above that my invention provides an elastomeric torsion spring assembly for vehicle hood hinges wherein the assembly includes a hinge strap having an end portion attached to the outer diameter of an elastomeric torsion ring or tube with the inner diameter of the torsion ring or tube attached to a cylindrical member which is carried by a bracket in a manner preventing relative rotation. The cylindrical member becomes a pivot around which the hood may be rotated and the hinge strap has a projecting arm for attachment of the hood. Further, I have shown an overcenter stop assembly which aids in maintaining the hinge in hood raised position requiring the application of extra force to begin closure of the hood.

Although the teachings of my invention have herein been discussed with reference to specific theories and embodiments, it is to be understood that these are by way of illustration only and that others may wish to utilize my invention in different designs or applications.

I claim as my invention:

1. An automotive vehicle hood hinge assembly comprising: a bracket attachable to the body of a vehicle in non-movable relation therewith, a hinge strap having an end attachable to a vehicle hood in non-movable relation therewith and having a second end attached to the outer surface of an elastomeric torsion spring in non-relatively rotatable relationship therewith, an inner surface of the torsion spring attached to the bracket in non-relatively rotatable relation therewith, the hood relatively rotatable with respect to the vehicle body, said relative rotation accommodated by elastomer torsional flow within the elastomeric torsional spring, abuttable means carried respectively by the hinge strap and the bracket, the abuttable means being brought into abutment by rotation of the hinge strap relative to the bracket, further rotation requiring compression of the elastomeric spring, compression of the elastomeric spring allowing an abutment means on the strap to pass an abutment means on the bracket during further rotation of the strap relative to the bracket, movement of the abutment means on the strap past the abutment means on the bracket relieving said compression whereby the abutment means provide an overcenter stop.

2. The assembly of the claim 1 wherein the attachment of the bracket to the elastomeric torsional spring provides a pivotable hinge for a hood attached to the hinge strap.

3. The assembly of the claim 2 wherein the hinge strap has a hood closed rotational position and a hood open rotational position and the abutment means are positioned to contact adjacent the hood open position.

4. An automotive vehicle hood hinge assembly comprising: a U-shaped bracket having partially parallel legs innerconnected by a bight section, aligned bores in the legs spaced from the bight, a tightenable bolt member received through the bores and extending between the legs in spaced relation to the bight, a cylindrical member received around the bolt intermediate the legs, means restraining rotation of the cylindrical member relative to the bracket, an elastomeric body received around the cylindrical member having an inner diameter attached thereto in a non-relatively rotatable manner with an outer surface of the elastomeric body attached to one end of a hinge strap in a non-relatively rotatable manner, a second end of the hinge strap attached to a vehicle hood, rotation of the strap relative to the bracket accommodated and resisted by torsional elastomeric displacement within the elastomeric body, the attachment of the elastomeric body to the cylindrical member providing a pivot for the hood, the hinge strap having an outer projection thereon positioned and dimensioned to abut a projection on the bight section during rotation of the hinge strap to a first angular position, further rotation of the hinge strap beyond the first position compressing the elastomer body allowing inward movement of the strap projection relative to the elastomer body, said inward movement allowing movement of the strap projection beyond the first position past the bight projection, movement of the strap projection past the bight projection releasing the compression.

5. The assembly of claim 4 wherein the elastomer body is a thicked wall tube.

6. The assembly of claim 5 wherein the means resisting rotation of the cylindrical member comprises serrated end faces on the cylindrical member urged into mechanical interference contact with the legs of the bracket by tightening of the bolt.

7. The assembly of claim 6 wherein the body has a metal layer fastened to its outer surface, the hinge strap fastened to the metal layer.

8. The assembly of claim 5 wherein at least one relatively incompressible layer is received within the body intermediate an inner and outer diameter of the body.

* * * * *